US011393421B2

(12) United States Patent
Iwasa

(10) Patent No.: US 11,393,421 B2
(45) Date of Patent: Jul. 19, 2022

(54) LIQUID CRYSTAL DISPLAY APPARATUS AND METHOD OF MANUFACTURING THE SAME

(71) Applicant: JVCKENWOOD Corporation, Yokohama (JP)

(72) Inventor: Takayuki Iwasa, Yokohama (JP)

(73) Assignee: JVCKENWOOD CORPORATION, Yokohama (JP)

( * ) Notice: Subject to any disclaimer, the term of this patent is extended or adjusted under 35 U.S.C. 154(b) by 0 days.

(21) Appl. No.: 17/338,978

(22) Filed: Jun. 4, 2021

(65) Prior Publication Data

US 2021/0295791 A1 Sep. 23, 2021

Related U.S. Application Data

(63) Continuation of application No. PCT/JP2020/001812, filed on Jan. 21, 2020.

(30) Foreign Application Priority Data

Mar. 22, 2019 (JP) ..... JP2019-054891

(51) Int. Cl.
*G09G 3/36* (2006.01)

(52) U.S. Cl.
CPC ..... *G09G 3/3614* (2013.01); *G09G 3/3648* (2013.01); *G09G 2300/0823* (2013.01); *G09G 2310/0286* (2013.01)

(58) Field of Classification Search
CPC ..... G09G 3/3614; G09G 3/3648; G09G 2300/0823; G09G 2310/0286
See application file for complete search history.

(56) References Cited

U.S. PATENT DOCUMENTS 5,091,722 A * 2/1992 Kitajima ..... G09G 3/2011 348/E3.015
6,219,019 B1 * 4/2001 Hasegawa ..... G09G 3/3614 345/96
7,375,708 B2 * 5/2008 Kubota ..... G09G 3/3688 345/213
7,800,573 B2 * 9/2010 Woo ..... G09G 3/3688 345/55
8,305,313 B2 * 11/2012 Furuya ..... G09G 3/3655 345/87
8,576,150 B2 * 11/2013 Iwasa ..... G09G 3/3614 345/87
8,723,849 B2 * 5/2014 Iwasa ..... G09G 3/3648 257/213

(Continued)

FOREIGN PATENT DOCUMENTS

JP 2009-223289 A 10/2009

*Primary Examiner* — Michael J Jansen, II
(74) *Attorney, Agent, or Firm* — Procopio, Cory, Hargreaves & Savitch LLP

(57) ABSTRACT

A liquid crystal display apparatus includes a shift register unit that sequentially takes in a video signal including s-bit width for the number of columns of a plurality of pixels, a 1-line latch unit that concurrently outputs a plurality of the video signals taken by the shift register unit, comparator units that convert the plurality of video signals output from the 1-line latch unit into a plurality of analog voltages, respectively, and an analog switch unit that switches whether or not the plurality of analog voltages are supplied to the plurality of data lines, respectively.

7 Claims, 11 Drawing Sheets

(56) References Cited

U.S. PATENT DOCUMENTS

| | | | | |
|---|---|---|---|---|
| 9,412,298 | B2 * | 8/2016 | Nomura | G09G 3/3233 |
| 10,957,274 | B1 * | 3/2021 | Iwasa | G09G 3/3614 |
| 11,054,708 | B2 * | 7/2021 | Iwasa | G02F 1/1368 |
| 11,287,710 | B2 * | 3/2022 | Iwasa | G09G 3/3614 |
| 2002/0149606 | A1 * | 10/2002 | Kubota | G09G 3/2011 345/690 |
| 2006/0214898 | A1 * | 9/2006 | Woo | G09G 3/3688 345/90 |
| 2009/0219238 | A1 | 9/2009 | Furuya et al. | |
| 2012/0050147 | A1 * | 3/2012 | Iwasa | G09G 3/3614 345/96 |
| 2012/0200548 | A1 * | 8/2012 | Iwasa | G09G 3/3648 345/94 |
| 2014/0285405 | A1 * | 9/2014 | Nomura | G09G 3/3291 345/55 |
| 2021/0072608 | A1 * | 3/2021 | Iwasa | G09G 3/3614 |
| 2021/0074235 | A1 * | 3/2021 | Iwasa | G09G 3/3688 |
| 2021/0149264 | A1 * | 5/2021 | Iwasa | G02F 1/1339 |
| 2021/0295791 | A1 * | 9/2021 | Iwasa | G09G 3/3614 |

* cited by examiner

LIQUID CRYSTAL DISPLAY APPARATUS AND METHOD OF MANUFACTURING THE SAME

CROSS REFERENCE TO RELATED APPLICATION

This application is a Bypass Continuation of PCT/JP2020/001812 filed on Jan. 21, 2020, which is based upon and claims the benefit of priority from Japanese Patent Application No. 2019-054891, filed on Mar. 22, 2019, the entire contents of which are incorporated herein by reference.

BACKGROUND

The present invention relates to a liquid crystal display apparatus, and a method of manufacturing the same, and relates to, for example, a liquid crystal display apparatus and a method of manufacturing the same which are suitable for enhancing reliability.

The realization and expanding usage of ultra-high speed fifth generation communication technology "5G" have been progressed. In order to realize 5G, in the optical communication field, optical communication systems such as an optical network system formed in a ring shape and an optical wavelength multiplex communication system capable of supporting a rapidly increasing amount of information have been proposed.

In these optical communication systems, a ROADM (Reconfigurable Optical And Drop Multiplexer) apparatus is used. The ROADM apparatus is capable of branching or inserting an optical signal without converting or relaying the optical signal into an electric signal. As an optical switching apparatus in the ROADM apparatus, a WSS (Wavelength Selective Switch) apparatus is used. An LCOS (Liquid Crystal on Silicon, hereinafter referred to as a liquid crystal display apparatus) using a phase modulation function of liquid crystal is used as an optical switching element in the WSS apparatus.

A technique relating to a liquid crystal display apparatus is disclosed in, for example, Japanese Unexamined Patent Application Publication No. 2009-223289. The liquid crystal display apparatus disclosed in Japanese Unexamined Patent Application Publication No. 2009-223289 includes: a plurality of pixels arranged in a matrix, a plurality of data lines provided corresponding to respective columns of the plurality of pixels, a shift register circuit for sequentially taking in video signals for the number of columns of the plurality of pixels; a latch circuit for concurrently outputting the plurality of video signals taken by the shift register circuit, a plurality of comparators for converting the plurality of video signals output from the latch circuit into a plurality of analog voltages, respectively, and an analog switch unit for switching whether or not the plurality of analog voltages are supplied to the plurality of data lines, respectively.

Japanese Unexamined Patent Application Publication No. 2009-223289 does not disclose details of the wiring of a plurality of signal lines where a plurality of bit signals constituting video signals having a plurality of bit widths are propagated, respectively. Therefore, in the signal line where a frequently changing bit signal of a least significant bit is propagated, a current leaks from the signal line to a wiring interlayer film, or a wiring resistance is partially increased due to a defect during manufacturing processing or the like, so that a progressive failure due to long-term continuous use is likely to occur. As a result, there has been a problem that the reliability of the liquid crystal display apparatus disclosed in Japanese Unexamined Patent Application Publication No. 2009-223289 is deteriorated.

SUMMARY

An example aspect of an embodiment is a liquid crystal display apparatus including: a plurality of pixels; a plurality of data lines provided so as to correspond to respective columns of the plurality of pixels; a shift register unit configured to sequentially take in a video signal including s (s is an integer greater than or equal to 2)-bit width for the number of columns of the plurality of pixels; a latch unit configured to concurrently output a plurality of the video signals taken by the shift register unit; a plurality of comparators configured to convert the plurality of video signals output from the latch unit into a plurality of analog voltages, respectively; and an analog switch unit configured to switch whether or not the plurality of analog voltages are supplied to the plurality of data lines, respectively. The shift register unit includes first to s-th shift register circuits configured to sequentially take in first to s-th bit signals constituting the video signals including the s-bit width for the number of columns of the plurality of pixels, respectively. The latch unit comprises first to s-th latch circuits configured to concurrently output the first to s-th bit signals for the number of columns of the plurality of pixels taken by the first to s-th register circuits, respectively. Among the first to s-th latch circuits, the first latch circuit configured to concurrently output a plurality of the first bit signals, which are bit signals of a least significant bit, is disposed closer to the plurality of comparators than the s-th latch circuit configured to concurrently output the plurality of s-th bit signals, which are bit signals of a most significant bit.

Another example aspect of the embodiment is a method of manufacturing a liquid crystal display apparatus including: a plurality of pixels; a plurality of data lines provided so as to correspond to respective columns of the plurality of pixels; a shift register unit configured to sequentially take in a video signal including s (s is an integer greater than or equal to 2)-bit width for the number of columns of the plurality of pixels; a latch unit configured to concurrently output a plurality of the video signals taken by the shift register unit; a plurality of comparators configured to convert the plurality of video signals output from the latch unit into a plurality of analog voltages, respectively; and an analog switch unit configured to switch whether or not the plurality of analog voltages are supplied to the plurality of data lines, respectively. The shift register unit includes first to s-th shift register circuits configured to sequentially take in first to s-th bit signals constituting the video signals including the s-bit width for the number of columns of the plurality of pixels, respectively. The latch unit includes first to s-th latch circuits configured to concurrently output the first to s-th bit signals for the number of columns of the plurality of pixels taken by the first to s-th register circuits, respectively. The method includes disposing, among the first to s-th latch circuits, the first latch circuit configured to concurrently output a plurality of the first bit signals, which are bit signals of a least significant bit, closer to the plurality of comparators than the s-th latch circuit configured to concurrently output the plurality of s-th bit signals, which are bit signals of a most significant bit.

DETAILED DESCRIPTION

Study in Advance by Inventors

Prior to giving a description of a liquid crystal display apparatus according to a first embodiment, contents studied in advance by the inventors will be described.

Figure 1:
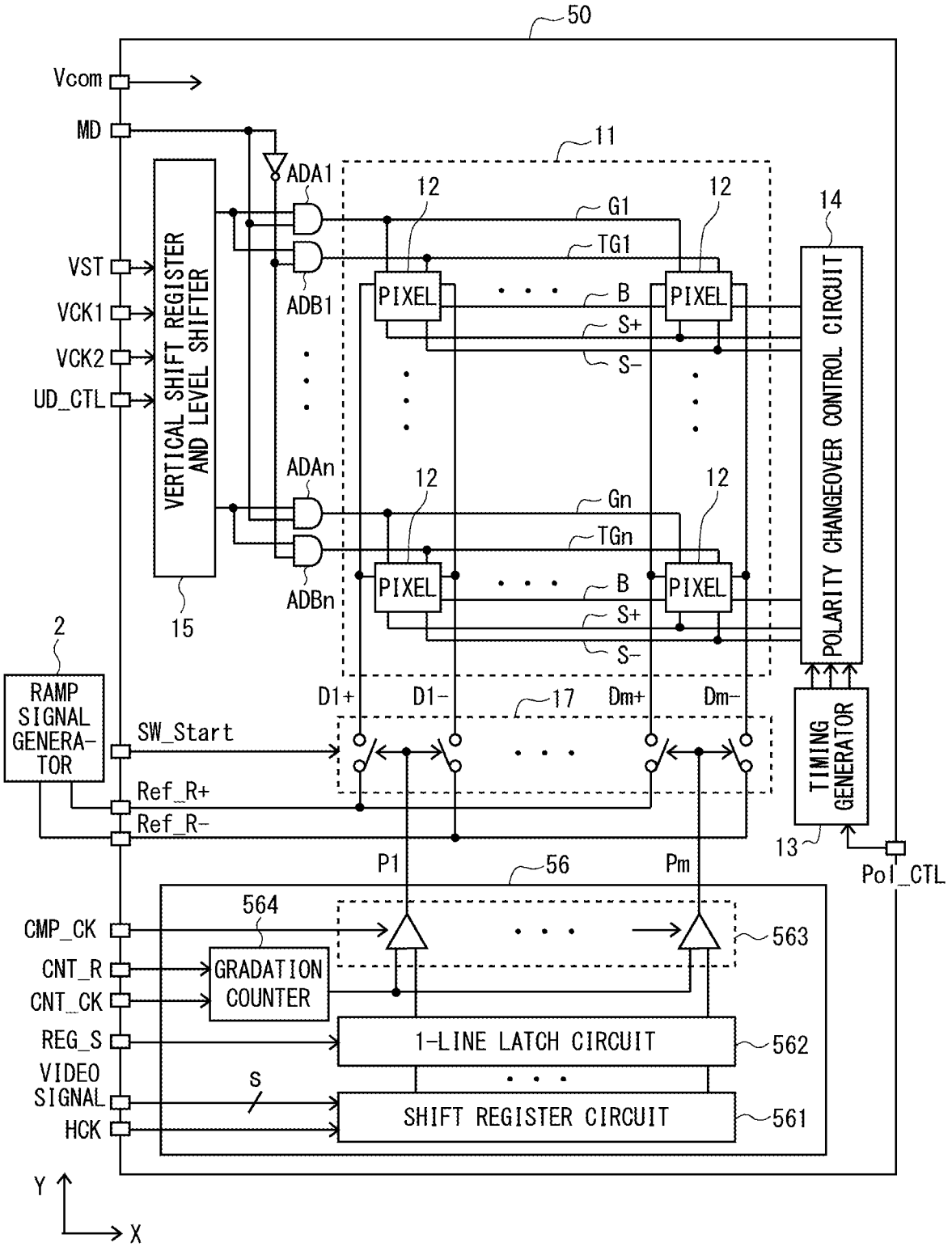
FIG. 1 is a diagram showing a configuration example of a liquid crystal display apparatus in a conceptual stage before arriving at an embodiment.

Configuration of Liquid Crystal Display Apparatus 50 in Conceptual Stage FIG. 1 is a diagram showing a configuration example of an active matrix type liquid crystal display apparatus 50 in a conceptual stage. As shown in FIG. 1, the liquid crystal display apparatus 50 includes an image display unit 11, a timing generator 13, a polarity changeover control circuit 14, a vertical shift register and level shifter 15, a horizontal driver 56, an analog switch unit 17, and AND circuits ADA1 to ADAn and ADB1 to ADBn. The horizontal driver 56, which composes a data line drive circuit together with the analog switch unit 17, includes a shift register circuit 561, a 1-line latch circuit 562, a comparator unit 563, and a gradation counter 564. Note that FIG. 1 also shows a ramp signal generator 2 connected to the liquid crystal display apparatus 50 in a normal operation.

Figure 2:
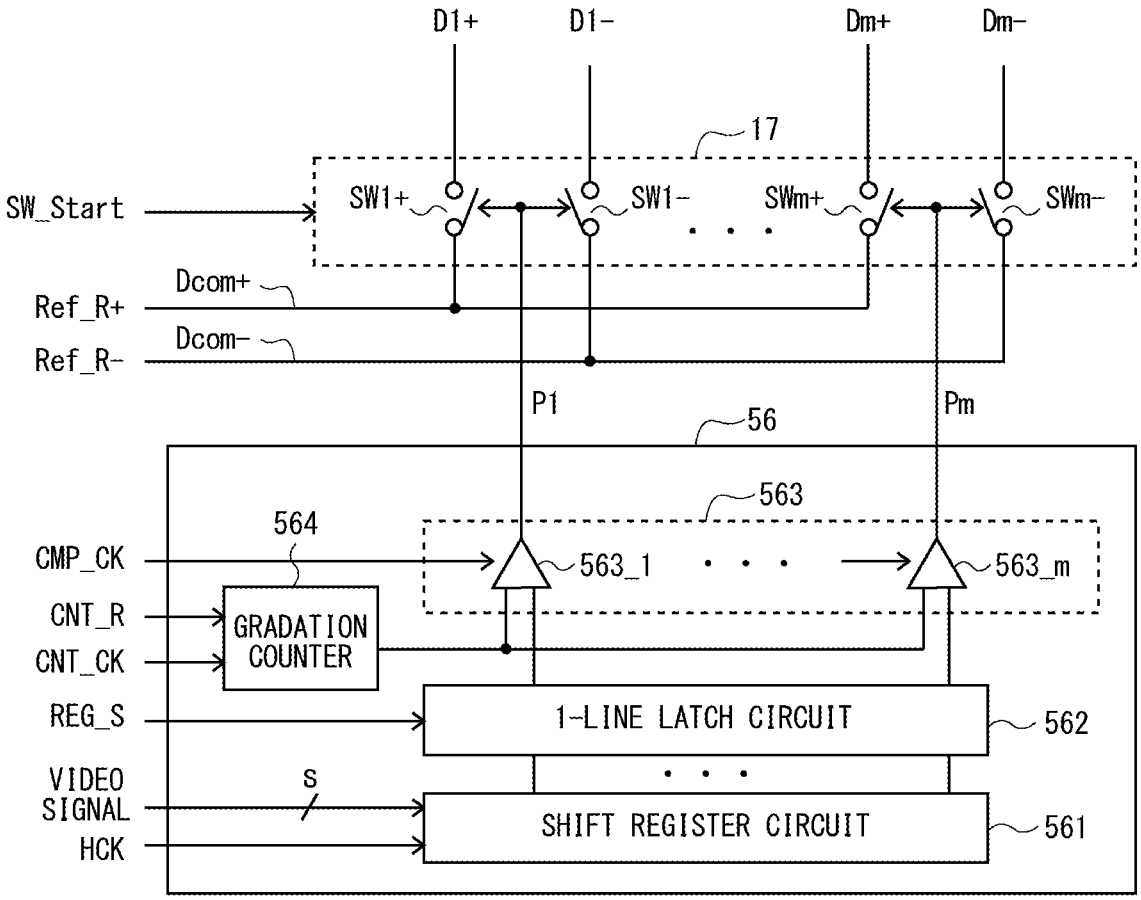
FIG. 2 is a diagram showing a horizontal driver 56 and an analog switch unit 17 provided in the liquid crystal display apparatus shown in FIG. 1 in more detail.

FIG. 2 is a diagram showing the horizontal driver 56 and the analog switch unit 17 provided in the liquid crystal display apparatus 50 in more detail. The comparator unit 563 includes m (m is an integer equal to or larger than 2) comparators 563_1 to **563_*m* that correspond to pixels 12 of m columns. The analog switch unit 17 includes m sets of switch elements SW1+, SW1− to SWm+, and SWm− that correspond to pixels 12** of m columns.

In a pixel arrangement region of the image display unit 11, row scan lines G1 to Gn of n (n is an integer equal to or larger than 2) rows and switch selection lines for reading TG1 to TGn of n rows extending in a horizontal direction (an X-axis direction), and a set of data lines D1+, D1− to Dm+, and Dm− of m columns extending in a vertical direction (a Y-axis direction) are wired. Further, in the pixel arrangement region of the image display unit 11, gate control signal lines S+ and S−, and a gate control signal line B are wired.

The image display unit 11 includes a plurality of pixels 12 that are regularly arranged. Here, the plurality of pixels 12 are arranged in a two-dimensional matrix form at a total of n×m intersection parts in which the row scan lines G1 to Gn of n rows extending in the horizontal direction (the X-axis direction) intersect with the m sets of data lines D1+, D1− to Dm+, and Dm− extending in the vertical direction (the Y-axis direction).

A row scan line Gj (j is any integer from 1 to n) and a switch selection line for reading TGj are connected in common to each of m pixels 12 arranged in the j-th row. Further, the data lines Di+ and Di− (i is any integer from 1 to m) are connected in common to each of n pixels 12 arranged in the i-th column. Further, each of the gate control signal lines S+ and S− and the gate control signal line B is connected in common to all the pixels 12. Alternatively, each of the gate control signal lines S+ and S− and the gate control signal line B may be provided separately for each row.

The polarity changeover control circuit 14 outputs, based on a timing signal generated by the timing generator 13, a gate control signal for the positive polarity (hereinafter this signal is referred to as a gate control signal S+) to the gate control signal line S+, outputs a gate control signal for the negative polarity (hereinafter this signal is referred to as a gate control signal S−) to the gate control signal line S−, and further outputs a gate control signal (hereinafter this signal is referred to as a gate control signal B) to the gate control signal line B.

The vertical shift register and level shifter 15 outputs scan pulses of n rows from a first row to an n-th row one row at a time in series in a cycle of one horizontal scan period HST. The AND circuits ADA1 to ADAn respectively control, based on a mode switch signal MD externally supplied, whether or not to output the scan pulses of n rows sequentially output from the vertical shift register and level shifter 15 one row at a time to the row scan lines G1 to Gn. The AND circuits ADB1 to ADBn respectively control, based on the mode switch signal MD externally supplied, whether or not to output the scan pulses of n rows sequentially output from the vertical shift register and level shifter 15 one row at a time to the switch selection lines for reading TG1 to TGn.

For example, in a case of an operation in which a video signal is written into the pixel 12 (image writing operation), an H level mode switch signal MD is externally supplied. In this case, the AND circuits ADA1 to ADAn respectively output the scan pulses of n rows sequentially output from the vertical shift register and level shifter 15 one row at a time to the row scan lines G1 to Gn. On the other hand, the AND circuits ADB1 to ADBn do not respectively output the scan pulses of n rows sequentially output from the vertical shift register and level shifter 15 one row at a time to the switch selection lines for reading TG1 to TGn. Therefore, each of the switch selection lines for reading TG1 to TGn is fixed to the L level.

On the other hand, when the video signal written into the pixel 12 is read out (image reading operation), an L level mode switch signal MD is externally supplied. In this case, the AND circuits ADB1 to ADBn respectively output the scan pulses of n rows sequentially output from the vertical shift register and level shifter 15 one row at a time to the switch selection lines for reading TG1 to TGn. On the other hand, the AND circuits ADA1 to ADAn do not respectively output the scan pulses of n rows sequentially output from the vertical shift register and level shifter 15 one row at a time to the row scan lines G1 to Gn. Therefore, each of the row scan lines G1 to Gn is fixed to the L level.

Specific Configuration Example of Pixel 12

Figure 3:
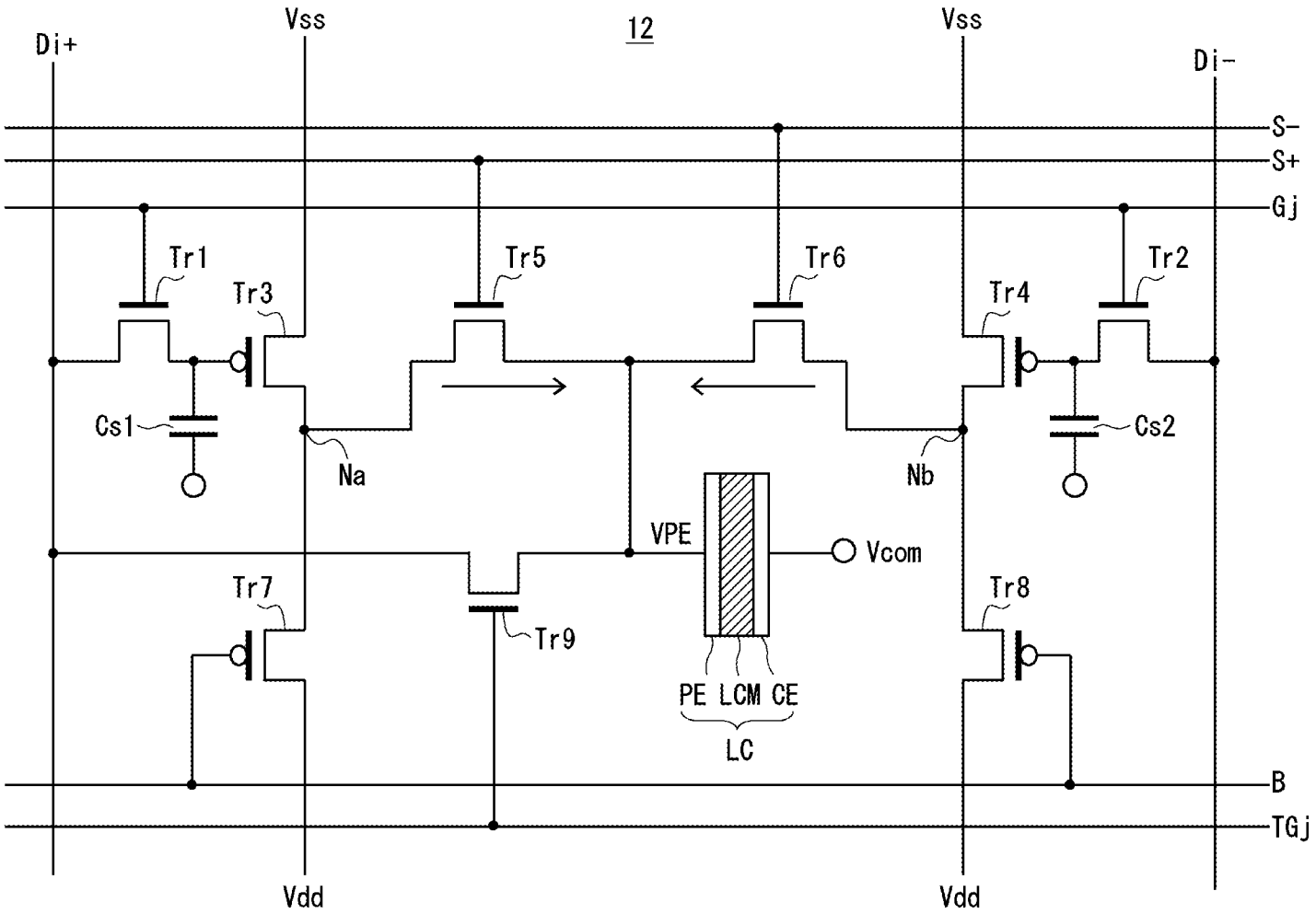
FIG. 3 is a diagram showing a specific configuration example of a pixel provided in the liquid crystal display apparatus shown in FIG. 1.

FIG. 3 is a diagram showing a specific configuration example of the pixel 12. In this example, the pixel 12 provided in the j-th row and the i-th column out of pixels 12 of n rows×m columns will be described.

As shown in FIG. 3, the pixel 12 includes N channel MOS transistors (hereinafter they are simply referred to as transistors) Tr1, Tr2, Tr5, Tr6, and Tr9 and P channel MOS transistors (hereinafter they are simply referred to as transistors) Tr3, Tr4, Tr7, and Tr8.

The transistor Tr1 and a holding capacitor Cs1 compose a sample and hold circuit configured to sample and hold a positive-polarity video signal supplied via the data line Di+. Specifically, in the transistor Tr1, the source is connected to one data line Di+ of the data line pair, the drain is connected to the gate of the transistor Tr3, and the gate is connected to the row scan line Gj. The holding capacitor Cs1 is provided between the gate of the transistor Tr3 and a ground voltage terminal Vss.

The transistor Tr2 and a holding capacitor Cs2 compose a sample and hold circuit configured to sample and hold the negative-polarity video signal supplied via the data line Di−. Specifically, in the transistor Tr2, the source is connected to the other data line Di− of the data line pair, the drain is connected to the gate of the transistor Tr4, and the gate is connected to the row scan line Gj. The holding capacitor Cs2 is provided between the gate of the transistor Tr3 and the ground voltage terminal Vss. Note that the holding capacitors Cs1 and Cs2 are provided independently of each other and respectively hold positive-polarity and negative-polarity video signals in parallel.

The transistors Tr3 and Tr7 compose a source follower buffer (buffer for impedance conversion) that outputs a voltage held in the holding capacitor Cs1. Specifically, in the transistor Tr3 of the source follower, the drain is connected to the ground voltage line Vss, and the source is connected to a node Na. In the transistor Tr7 used as a constant current load in which bias control is possible, the source is connected to a power supply voltage line Vdd, the drain is connected to the node Na, and the gate is connected to the gate control signal line B.

The transistors Tr4 and Tr8 compose a source follower buffer that outputs the voltage held in the holding capacitor Cs2. Specifically, in the transistor Tr4 of the source follower, the drain is connected to the ground voltage line Vss, and the source is connected to a node Nb. In the transistor Tr8 used as a constant current load in which bias control is possible, the source is connected to the power supply voltage line Vdd, the drain is connected to the node Nb, and the gate is connected to the gate control signal line B.

The transistors Tr5 and Tr6 compose a polarity changeover switch. Specifically, in the transistor Tr5, the source is connected to the node Na, the drain is connected to a pixel drive electrode PE, and the gate is connected to one gate control signal line S+ of a pair of gate control signal lines. In the transistor Tr6, the source is connected to the node Nb, the drain is connected to the pixel drive electrode PE, and the gate is connected to the other gate control signal line S− of the pair of gate control signal lines.

A liquid crystal display element LC includes a pixel drive electrode (reflecting electrode) PE having light reflectivity, a common electrode CE having light transmissivity, the common electrode CE being disposed apart from the pixel drive electrode so as to face the pixel drive electrode, and liquid crystal LCM filled and sealed in a spatial area between them. A common voltage Vcom is applied to the common electrode CE. The transistor Tr9 is provided between the pixel drive electrode PE and the data line Di+, and is switched to be on or off by the switch selection line for reading TGj.

Video signals which are sampled by the analog switch unit 17 and have polarities different from each other are supplied to the data line pair Di+ and Di−. When the scan pulse output from the vertical shift register and level shifter 15 is supplied to the row scan line Gj, the transistors Tr1 and Tr2 are concurrently turned on. Accordingly, the voltages of the positive-polarity and negative-polarity video signals are respectively accumulated and held in the holding capacitors Cs1 and Cs2.

Note that the input resistance of the source follower buffer on each of the positive side and the negative side is almost infinite. Therefore, the charge accumulated in each of the holding capacitors Cs1 and Cs2 is not leaked and held until a new video signal is written after one vertical scan period is passed.

The transistors Tr5 and Tr6 that compose the polarity changeover switch (selection unit) complementarily switch ON/OFF in accordance with the gate control signals S+ and S−, thereby alternately selecting the output voltage of the positive-side source follower buffer (the voltage of the positive-polarity video signal) and the output voltage of the negative-side source follower buffer (the voltage of the negative-polarity video signal) and outputting the selected voltage to the pixel drive electrode PE. Accordingly, the voltage of the video signal whose polarity is periodically inverted is applied to the pixel drive electrode PE. In this way, in this liquid crystal display apparatus, the pixels themselves have a polarity inversion function. Therefore, by switching the polarity of the voltage of the video signal supplied to the pixel drive electrode PE at a high speed in each pixel, it is possible to perform AC drive at a high frequency regardless of the vertical scan frequency.

Description of AC Drive Method of Pixel 12

Figure 4:
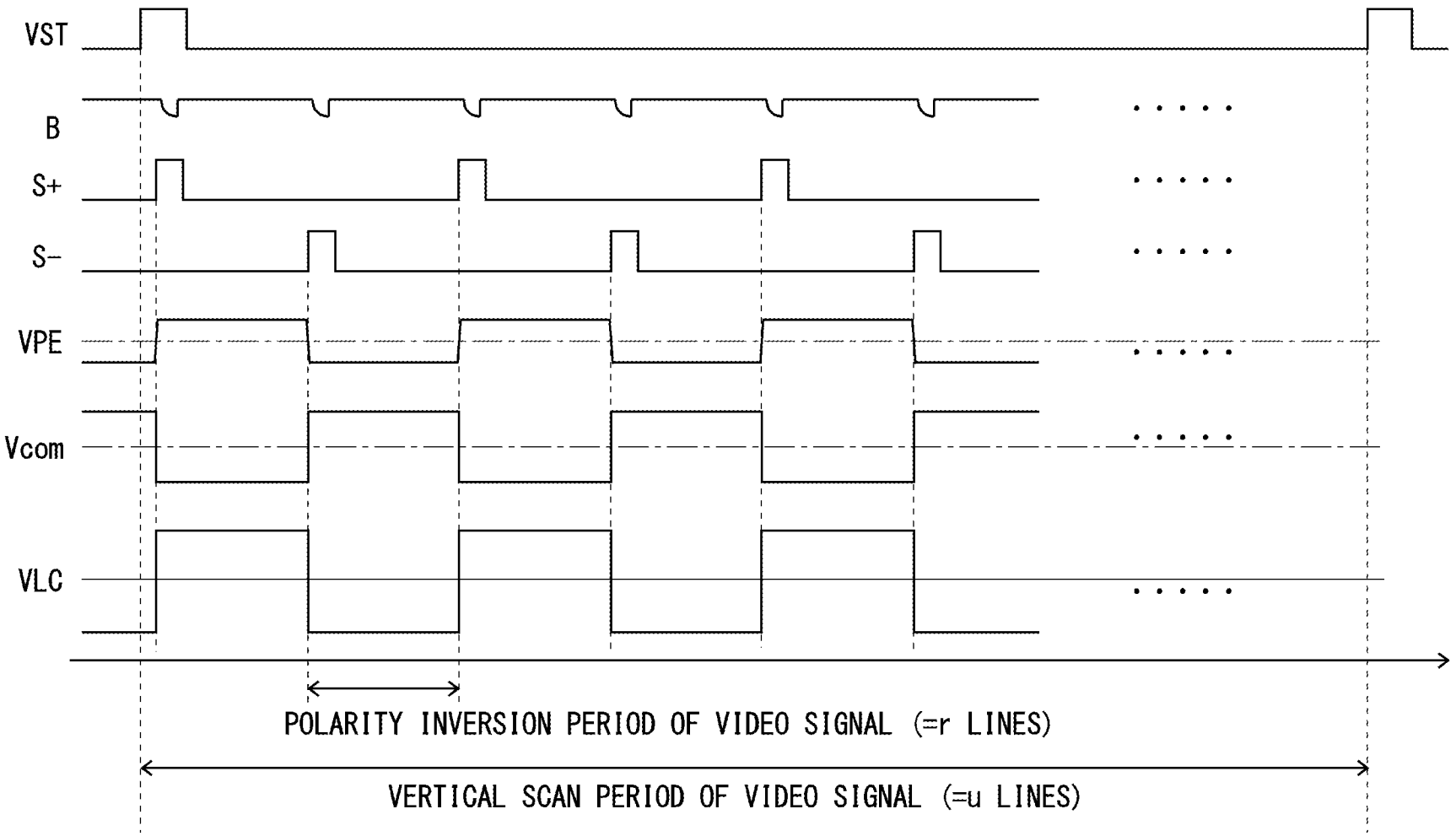
FIG. 4 is a timing chart for explaining a method of driving pixels by the liquid crystal display apparatus shown in FIG. 1.

FIG. 4 is a timing chart for describing an AC drive method of the pixel 12 by the liquid crystal display apparatus 50. In this example, the AC drive method of the pixel 12 provided in the j-th row and the i-th column out of the pixels 12 of n rows×m columns will be described.

Note that in FIG. 4, VST indicates a vertical synchronization signal, which is a reference for vertical scan of a video signal. B indicates a gate control signal to be supplied to each of the gates of the transistors Tr7 and Tr8 used as a constant current load of the source follower buffers of two types. S+ indicates a gate control signal to be supplied to the gate of the positive-side transistor Tr5 provided in the polarity changeover switch. S− indicates a gate control signal to be supplied to the gate of the negative-side transistor Tr6 provided in the polarity changeover switch. VPE indicates a voltage to be applied to the pixel drive electrode PE. Vcom indicates a voltage to be applied to the common electrode CE. VLC indicates an AC voltage to be applied to the liquid crystal LCM.

Figure 5:
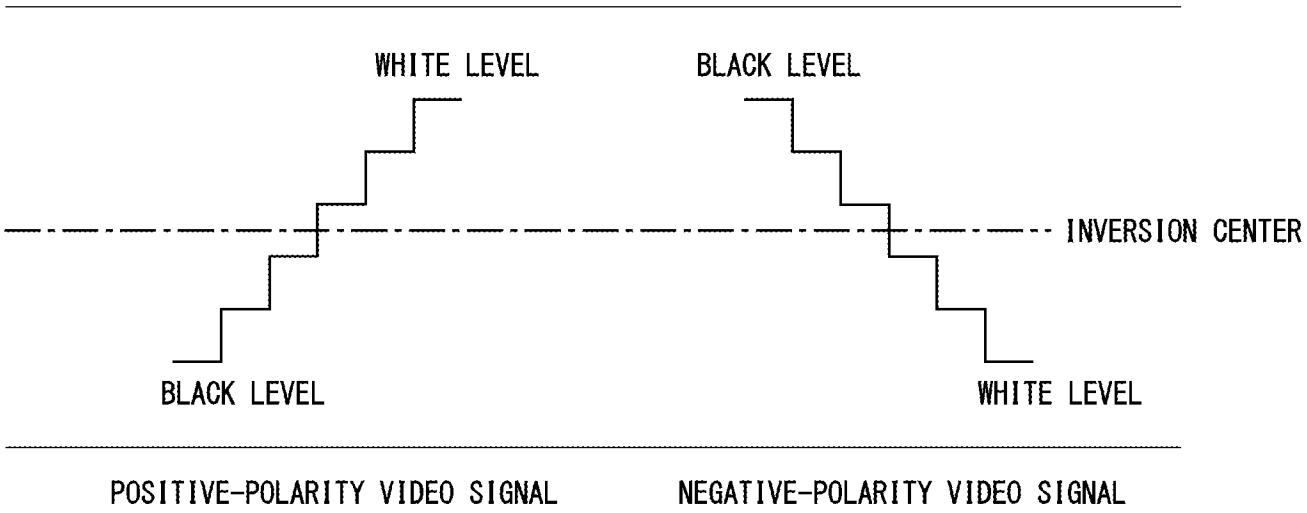
FIG. 5 is a diagram for illustrating a voltage level from black to white of each of a positive-polarity video signal and a negative-polarity video signal written into a pixel.

Further, FIG. 5 is a diagram for illustrating the voltage level from black to white of each of the positive-polarity video signal and the negative-polarity video signal written into the pixel 12. In the example of FIG. 5, the positive-polarity video signal indicates the black level when the voltage level is a minimum and indicates the white level when the voltage level is a maximum. On the other hand, the negative-polarity video signal indicates the white level when the voltage level is a minimum and indicates the black level when the voltage level is a maximum. Alternatively, the positive-polarity video signal may indicate the white level when the voltage level is a minimum and indicate the black level when the voltage level is a maximum. Further, the negative-polarity video signal may indicate the black level when the voltage level is a minimum and indicate the white level when the voltage level is a maximum. Note that the one-dotted chain line shown in FIG. 5 indicates the inversion center of the positive-polarity video signal and the negative-polarity video signal.

In the pixel 12, the transistor Tr9 maintains an off-state since the switch selection line for reading TGj is fixed to the L level. On the other hand, the transistors Tr1 and Tr2 are temporarily turned on when the scan pulse is supplied to the row scan line Gj. As a result, the voltages of the positive-polarity and negative-polarity video signals are accumulated and held in the holding capacitors Cs1 and Cs2, respectively.

As shown in FIG. 4, the positive-side transistor Tr5 is turned on in a period in which the gate control signal S+ indicates the H level. At this time, the gate control signal B is set to the L level, which causes the transistor Tr7 to be turned on, so that the positive-side source follower buffer becomes active. Accordingly, the pixel drive electrode PE is charged to the voltage level of the positive-polarity video signal. Note that the transistor Tr8 is turned on by setting the gate control signal B to the L level, so that the negative-side source follower buffer also becomes active. However, since the negative-side transistor Tr6 has been turned off, the pixel drive electrode PE is not charged to the voltage level of the negative-polarity video signal. At a timing when the pixel drive electrode PE is fully charged, the gate control signal B is switched from the L level to the H level, and the gate control signal S+ is switched from the H level to the L level. As a result, the pixel drive electrode PE falls into a floating state, so that a positive-polarity drive voltage is held in a liquid crystal capacitor.

On the other hand, the negative-side transistor Tr6 is turned on in a period in which the gate control signal S− indicates the H level. At this time, the gate control signal B is set to the L level, which causes the negative-side transistor Tr8 to be turned on, so that the negative-side source follower buffer becomes active. Accordingly, the pixel drive electrode PE is charged to the voltage level of the negative-polarity video signal. Note that the transistor Tr7 is turned on by setting the gate control signal B to the L level, so that the positive-side source follower buffer also becomes active. However, since the positive-side transistor Tr5 has been turned off, the pixel drive electrode PE is not charged to the voltage level of the positive-polarity video signal. At a timing when the pixel drive electrode PE is fully charged, the gate control signal B is switched from the L level to the H level, and the gate control signal S− is switched from the H level to the L level. As a result, the pixel drive electrode PE falls into a floating state, so that a negative-polarity drive voltage is held in the liquid crystal capacitor.

By alternately repeating the aforementioned operations on the positive side and the negative side, the drive voltage VPE, which is made to be AC by using the voltage of the positive-polarity video signal and the voltage of the negative-polarity video signal, is applied to the pixel drive electrode PE.

Note that the charge held in the holding capacitors Cs1 and Cs2 is not directly transmitted to the pixel drive electrode PE, but transmitted to the pixel drive electrode PE via the source follower buffer, so that even when charging and discharging of the voltages of the positive-polarity and negative-polarity video signals are repeatedly performed in the pixel drive electrode PE, pixel drive in which the voltage level does not attenuate can be performed without neutralizing the charge.

Further, as shown in FIG. 4, the voltage level of the voltage Vcom applied to the common electrode CE is switched to the level opposite to the applied voltage VPE in synchronization with the switching of the voltage level of the voltage VPE applied to the pixel drive electrode PE. Note that the voltage Vcom applied to the common electrode CE uses, as an inversion reference, a voltage which is approximately equal to an inversion reference voltage of the voltage VPE applied to the pixel drive electrode PE.

Here, since a substantial AC voltage VLC applied to the liquid crystal LCM is a differential voltage between the voltage VPE applied to the pixel drive electrode PE and the voltage Vcom applied to the common electrode CE, an AC voltage VLC that does not include DC components is applied to the liquid crystal LCM. In this way, by switching the voltage Vcom applied to the common electrode CE in a reverse phase with respect to the voltage VPE applied to the pixel drive electrode PE, the amplitude of the voltage to be applied to the pixel drive electrode PE can be made small, whereby it is possible to reduce the breakdown voltage and power consumption of the transistors that compose a circuit part of the pixel.

Note that even if the current that constantly flows through the source follower buffer per pixel is a small current of 1 μA, the current that constantly flows through all the pixels of the liquid crystal display apparatus may be too large to ignore. In a liquid crystal display apparatus having two million pixels for the full high vision, for example, the consumed current may reach 2 A. Therefore, in the pixels 12, the transistors Tr7 and Tr8 used as a constant current load are not always set to the ON state. Instead, the transistors Tr7 and Tr8 are set to the ON state only in a limited period within the period when the positive-side and negative-side transistors Tr5 and Tr6 are in the ON state. Accordingly, in the case when one source follower buffer is operated, the operation of the other source follower buffer can be stopped, so that it is possible to suppress increase of the consumed current.

The AC drive frequency of the liquid crystal display element LC does not depend on the vertical scan frequency and can be set freely by adjusting an inversion control period of the pixel itself. For example, the vertical scan frequency is assumed to be 60 Hz, which is used for a typical TV video signal, and the number of vertical period scan lines u for the full high vision is 1125 lines. It is further assumed that the polarity changeover in each pixel is performed in a cycle of about 15 lines. In other words, it is assumed that the number of lines r for each cycle of the polarity changeover in each pixel is set to 30 lines. In this case, the AC drive frequency of the liquid crystal becomes 60 Hz×1125/(15×2)=2.25 kHz. In other words, the liquid crystal display apparatus 50 is able to dramatically increase the AC drive frequency of the liquid crystal. Accordingly, it is possible to dramatically improve reliability, safety, and display quality of the video images displayed on a liquid crystal screen which are poor in the case in which the AC drive frequency of the liquid crystal is low.

Next, an operation of the liquid crystal display apparatus 50 in each operation mode will be described.

Operation of Liquid Crystal Display Apparatus 50 in Image Display Mode

Figure 6:
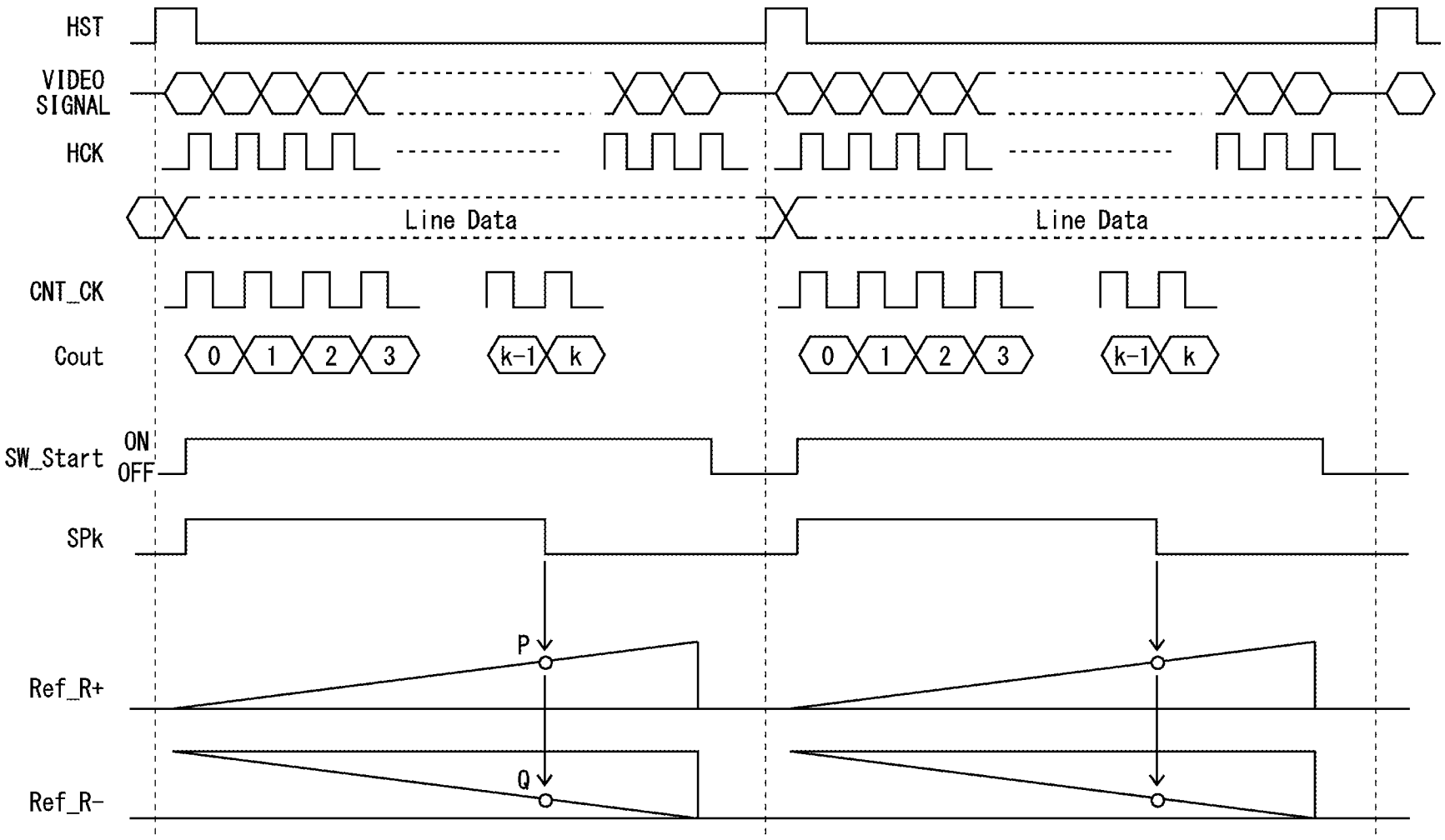
FIG. 6 is a timing chart showing an operation of the liquid crystal display apparatus shown in FIG. 1 in an image display mode.

First, an operation of the liquid crystal display apparatus 50 in an image display mode will be described with reference to FIG. 6. FIG. 6 is a timing chart showing the operation of the liquid crystal display apparatus 50 in the image display mode.

As shown in FIG. 6, when a pulse signal of a horizontal synchronization signal HST is supplied, the shift register circuit 561 sequentially takes in video signals having an s (s is an integer equal to or larger than 2)-bit width for m columns in synchronization with a clock signal HCK. The 1-line latch circuit 562 concurrently outputs the video signals for m columns taken by the shift register circuit 561 at a timing when the trigger signal REG_S temporarily becomes active.

The gradation counter 564 counts the number of times of rising of a clock signal CNT_CK, and outputs a gradation signal Cout of the gradation level corresponding to the count value. Here, the gradation counter 564 outputs the gradation signal Cout of the minimum level when one horizontal scan period is started (when the horizontal synchronization signal HST is raised), increases the gradation level of the gradation signal Cout in accordance with the increase in the count value, and outputs the gradation signal Cout at the maximum level when one horizontal scan period is ended (just before the next rising of the horizontal synchronization signal HST). Note that the count value by the gradation counter 564 is initialized to "0", for example, when the reset signal CNT_R becomes active in accordance with the rising of the horizontal synchronization signal HST.

The comparators 563_1 to **563_*m* of m columns provided in the comparator unit 563 are operated in synchronization with a clock signal CMP_CK, and make coincidence signals P1 to Pm active (e.g., the L level) at a timing when the gradation signal Cout output from the gradation counter 564 coincides with each of the video signals (line data) of m columns concurrently output from the 1-line latch circuit 562**.

The positive-side switch elements SW1+ to SWm+ out of the m sets of switch elements SW1+, SW1− to SWm+, and SWm− provided in the analog switch unit 17 are respectively provided between the data lines D1+ to Dm+ and a common wiring Dcom+. Further, the negative-side switch elements SW1− to SWm− are respectively provided between the data lines D1− to Dm− and a common wiring Dcom−. The m sets of switch elements SW1+, SW1− to SWm+, and SWm− switch ON and OFF by the coincidence signals P1 to Pm from the comparators 563_1 to **563_*m***.

Note that a reference ramp voltage Ref_R+, which is a ramp signal for the positive polarity output from the ramp signal generator 2, is supplied to the common wiring Dcom+. Further, a reference ramp voltage Ref_R−, which is a ramp signal for the negative polarity output from the ramp signal generator 2, is supplied to the common wiring Dcom−.

The reference ramp voltage Ref_R+ is a sweeping signal whose video image level changes from the black level to the white level from the start to the end of each horizontal scan period. The reference ramp voltage Ref_R− is a sweeping signal whose video image level changes from the white level to the black level from the start to the end of each horizontal scan period. Therefore, the reference ramp voltage Ref_R+ with respect to the common voltage Vcom and the reference ramp voltage Ref_R− with respect to the common voltage Vcom are in inverted relationship with each other.

Switch elements SW1+, SW1− to SWm+, and SWm− are concurrently turned on since a start signal SW_Start becomes active (e.g., the H level) at the time when the horizontal scan period is started. After that, the switch elements SW1+, SW1− to SWm+, and SWm− are switched from ON to OFF since the coincidence signals P1 to Pm respectively output from the comparators 563_1 to **563_*m*** become active (e.g., the L level). Note that at the time when the horizontal scan period is ended, the start signal SW_Start becomes inactive (e.g., the L level).

In the example shown in FIG. 6, a waveform indicating a timing of switching ON and OFF of the switch elements SWq+ and SWq− (q is any integer from 1 to m) provided so as to correspond to a pixel column into which a video signal of a gradation level k is written is indicated as a waveform SPk. Referring to FIG. 6, after the above switch elements SWq+ and SWq− are turned on since the start signal SW_Start is raised, the switch elements SWq+ and SWq− are switched from ON to OFF when the coincidence signal Pq becomes active. Here, the switch elements SWq+ and SWq− sample the reference ramp voltages Ref_R+ and Ref_R− (voltages P and Q in FIG. 6) at the timing when they are switched from ON to OFF. These sampled voltages P and Q are supplied to the data lines Dq+ and Dq−. In other words, analog voltages P and Q, which are the results of DA conversion of the video signal of the gradation level k, are respectively supplied to the data lines Dq+ and Dq−.

Note that in the image display mode, an H level mode switch signal MD is externally supplied. Therefore, scan pulses of n rows sequentially output from the vertical shift register and level shifter 15 one row at a time are respectively supplied to the row scan lines G1 to Gn. Accordingly, for example, the transistors Tr1 and Tr2 provided in each of the pixels 12 in the j-th row are temporarily turned on upon supply of the scan pulse to the row scan line Gj. As a result, in the holding capacitors Cs1 and Cs2 provided in each of the pixels 12 in the j-th row, the voltages of the corresponding positive-polarity and negative-polarity video signals are accumulated and held. On the other hand, the transistor Tr9 provided in each of the pixels 12 maintains the off-state. The following AC drive method of each of the pixels 12 has already been described above.

As described above, while the switch elements SW1+, SW1− to SWm+, and SWm− are concurrently turned on at the time when each horizontal scan period is started, each of them is turned off at an arbitrary timing in accordance with the gradation level of the image to be displayed on the corresponding pixel 12. In other words, all the switch elements SW1+, SW1− to SWm+, and SWm− may be concurrently turned off or they may be turned off at timings different from one another. The order in which they are turned off is not fixed.

As described above, the liquid crystal display apparatus 50 DA-converts the video signal using a ramp signal and then writes the obtained signal into the pixel 12, whereby it is possible to improve linearity of images.

Operation of Liquid Crystal Display Apparatus 50 in Pixel Inspection Mode

Next, an operation of the liquid crystal display apparatus 50 in the pixel inspection mode will be described. Note that an inspection apparatus is provided in place of the ramp signal generator 2 in the pixel inspection mode.

In the pixel inspection mode, first, the video signal for inspection is written from m pixels 12 in the first row to m pixels 12 of the n-th row one row at a time in series. The operation in this case is basically similar to that in the pixel display mode. After that, the video signal (pixel drive voltage VPE) written in the pixel 12 which is an inspection target is read out.

In the pixel reading operation, the mode switch signal MD to be externally supplied is switched from the H level to the L level. Therefore, the scan pulse in the j-th row to be inspected out of the scan pulses of n rows to be sequentially output from the vertical shift register and level shifter 15 is supplied to the switch selection line for reading TGj. Accordingly, the transistor Tr9 provided in each of the pixels 12 in the j-th row to be inspected is temporarily turned on upon supply of the scan pulse to the switch selection line for reading TGj. On the other hand, the transistors Tr1 and Tr2 provided in each of the pixels 12 maintain the off-state.

For example, in the pixel 12 provided in the j-th row and the i-th column, the transistor Tr9 is turned on, whereby the pixel drive electrode PE and the data line Di+ are made conductive, so that the voltage of the pixel drive electrode PE is read out to the data line Di+. At this time, the transistors Tr7 and Tr8 are made active and any one of the transistors Tr5 and Tr6 is turned on, whereby the pixel drive electrode PE falls into a state where it is driven by the source follower buffer composed of the transistors Tr3 and Tr7 or the transistors Tr4 and Tr8. Accordingly, the drive voltage VPE applied to the pixel drive electrode PE by the source follower buffer is read out to the data line Di+.

The m pixel drive voltages VPE which are read out from the m pixels 12 in the j-th row to be inspected to the data lines D1+ to Dm+ sequentially turn on the m sets of SW1+, SW1− to SWm+, and SWm− provided in the analog switch unit 17, whereby they are sequentially supplied to the common wiring Dcom+. Based on the m pixel drive voltages VPE sequentially supplied via the common wiring Dcom+, the inspection apparatus (not shown) provided in place of the ramp signal generator 2 detects whether or not there is a failure (pixel defects and deterioration in characteristics) in the m pixels 12 in the j-th row. The above inspection is performed in series one row at a time from the m pixels 12 in the first row to the m pixels 12 in the n-th row.

Here, in the pixel 12 to be inspected, the voltage VPE of the pixel drive electrode PE driven by the source follower buffer having a low output impedance is directly read out, whereby it is possible to accurately and easily detect defects or deterioration in characteristics of the pixel 12 to be inspected.

In the liquid crystal display apparatus 50, several measures are taken to improve image display performance.

Figure 7:
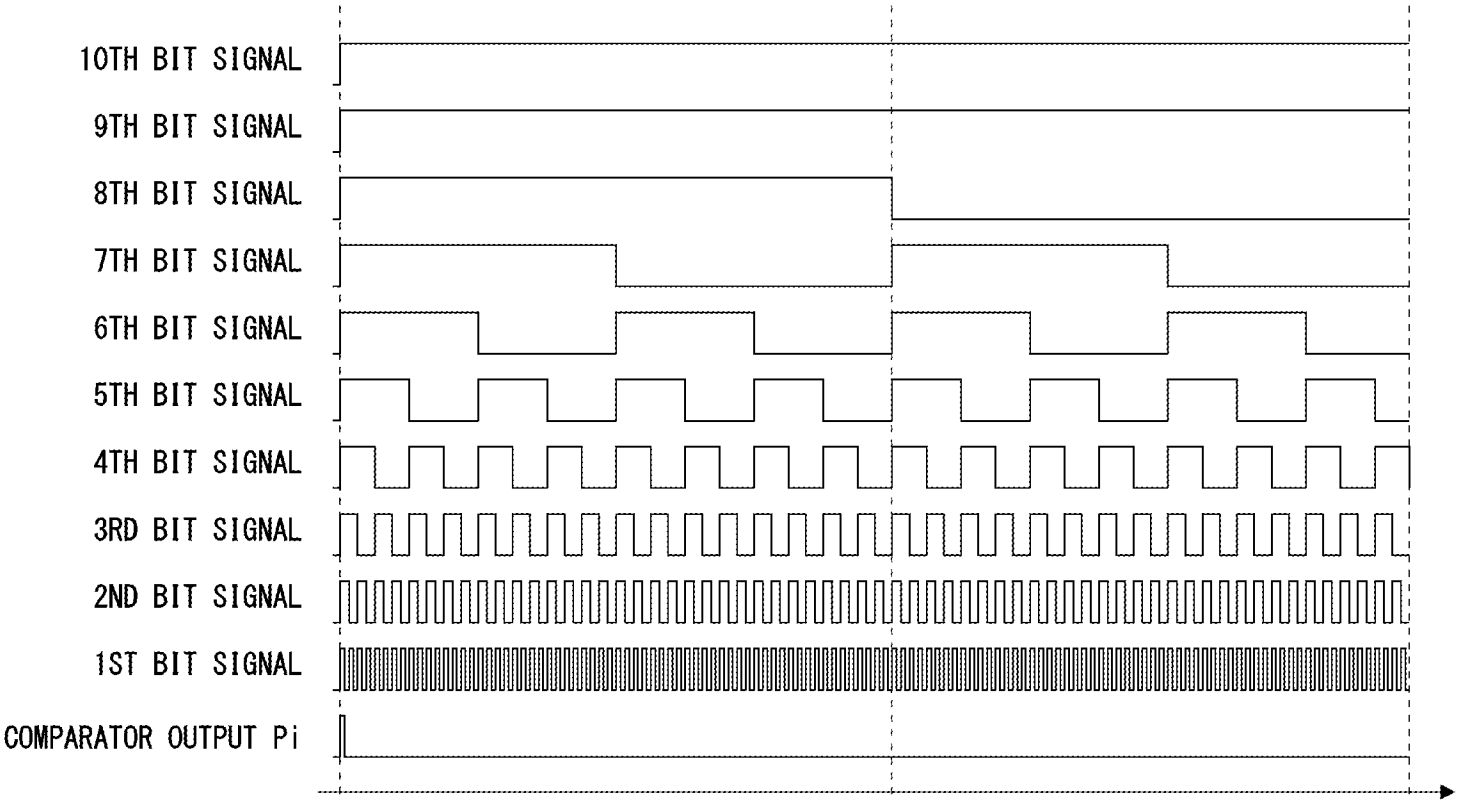
FIG. 7 is a timing chart for explaining signal changes of a plurality of bit signals constituting a video signal.

First, among first to s-th bit signals constituting a video signal having an s-bit width, a period of a signal change of the first bit signal, which is a bit signal of a least significant bit, is the shortest, the period of the signal change is gradually increased from the first bit signal to the tenth bit signal, and the period of the signal change of the tenth bit signal, which is the bit signal of a most significant bit, is the longest (see FIG. 7).

Thus, the first bit signal line where the frequently changing first bit signal is propagated is disposed closer to the ground wiring which is advantageous for high-frequency operations than other bit signal lines. The first bit signal line where the frequently changing first bit signal is propagated is disposed in an area distant from the analog switch unit 17 so that the first bit signal line will be less affected by noise from the analog switch unit 17 than other bit signal lines. By doing so, stable operations can be performed even when the frame rate is increased, and a sense of afterimage of a displayed image is eliminated.

Figure 8:
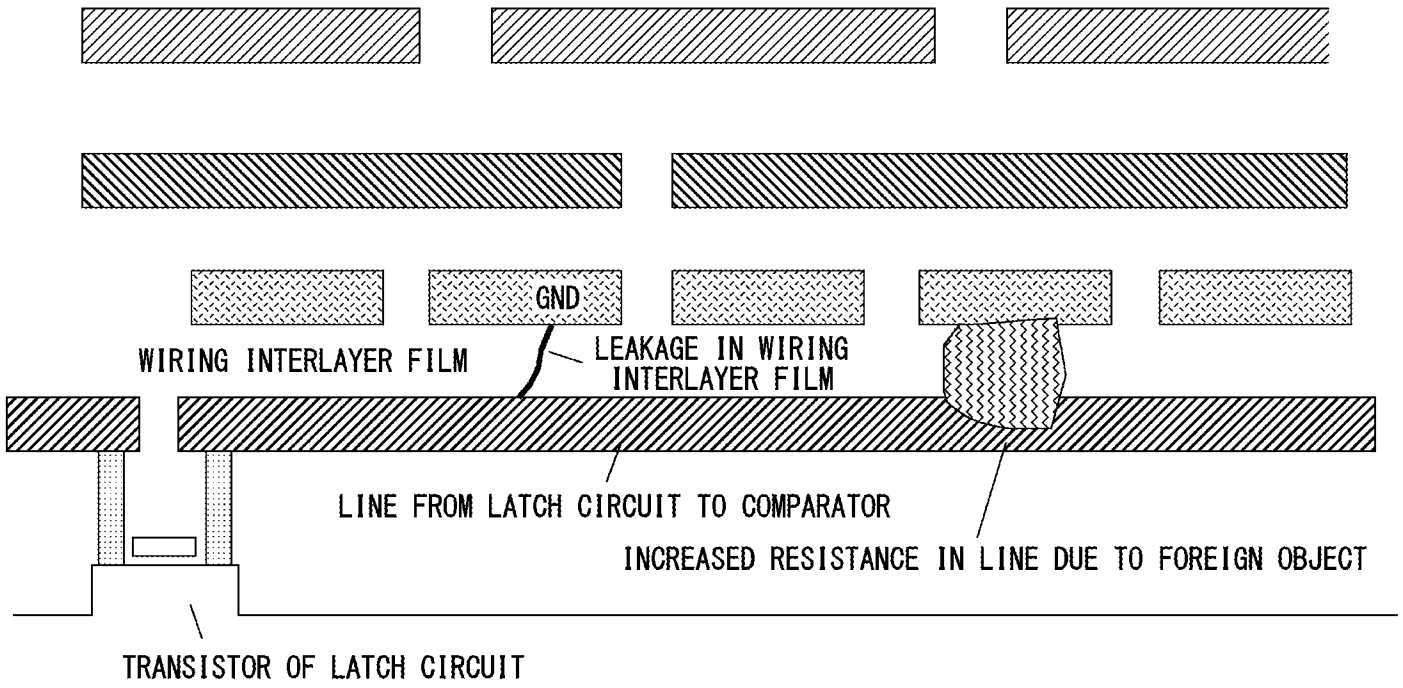
FIG. 8 is a schematic cross-sectional view for explaining current leakage and high resistance occurring in signal lines.

However, in the liquid crystal display apparatus 50, the length of the first bit signal line (specifically, the length of the first bit signal line from the 1-line latch circuit 562 to the comparator unit 563) where the frequently changing first bit signal is propagated is longer than the lengths of the other bit signal lines. Typically, the longer the length of the signal line, the more likely it is that a current may leak from the signal line to the wiring interlayer film, and the more susceptible the signal line is to the influence of dust caused by a defect during the manufacturing processing or the like and dimensional variations during pattern exposure, so that the wiring resistance is likely to be partially increased (see FIG. 8). Further, the more frequent the signal change, the more likely it is to cause a progressive failure due to the long-term continuous use under the influence of the current leakage and the higher resistance. For this reason, the progressive failure due to long-term continuous use is likely to occur in the first bit signal line where the frequently changing first bit signal is propagated. As a result, there is a problem that the reliability of the operation of the liquid crystal display apparatus 50 is deteriorated. There is another problem that the manufacturing yield is lowered, because the above-mentioned influence of dust due to the defect during the manufacturing processing or the like and the dimensional variation during pattern exposure also cause an operation defect in the initial state.

In order to solve the above-described problems, a liquid crystal display apparatus and a method of manufacturing the same according to a first embodiment capable of enhancing reliability and manufacturing yield have been found.

First Embodiment

Figure 9:
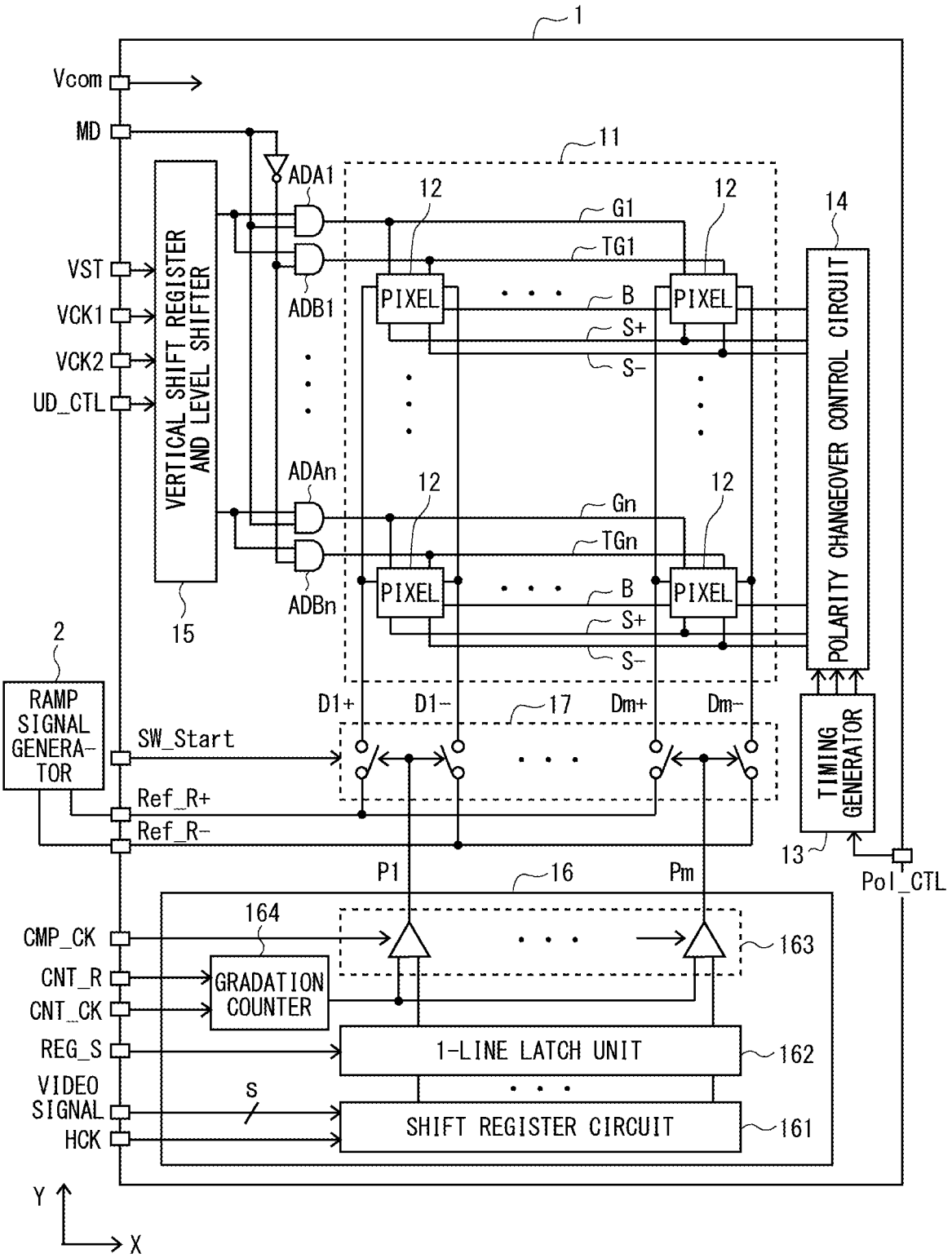
FIG. 9 is a diagram showing a configuration example of the liquid crystal display apparatus according to a first embodiment.

FIG. 9 is a block diagram showing a liquid crystal display apparatus 1 according to the first embodiment. The liquid crystal display apparatus 1 differs from the liquid crystal display apparatus 50 in that the liquid crystal display apparatus 1 includes a horizontal driver 16 in place of the horizontal driver 56. Since other configurations of the liquid crystal display apparatus 1 are the same as those of the liquid crystal display apparatus 50, the description thereof is omitted.

The horizontal driver 16 includes a shift register unit 161, a 1-line latch unit 162, a comparator unit 163, and a gradation counter 164. The shift register unit 161, the 1-line latch unit 162, the comparator unit 163, and the gradation counter 164 correspond to the shift register circuit 561, the 1-line latch circuit 562, the comparator unit 563, and the gradation counter 564, respectively.

Like the shift register circuit 561, the shift register unit 161 sequentially takes in video signals having an s (s is an integer equal to or larger than 2)-bit width for m columns in synchronization with a clock signal HCK. Like the 1-line latch circuit 562, the 1-line latch unit 162 concurrently takes in (latches) and outputs the video signals having the s-bit width for the m columns taken by the shift register unit 161 at a timing when the trigger signal REG_S temporarily becomes active.

The gradation counter 164 counts the number of times of rising of a clock signal CNT_CK, and outputs a gradation signal Cout of the gradation level corresponding to the count value. Here, the gradation counter 164 outputs the gradation signal Cout of the minimum level when one horizontal scan period is started (when the horizontal synchronization signal HST is raised), increases the gradation level of the gradation signal Cout in accordance with the increase in the count value, and outputs the gradation signal Cout at the maximum level when one horizontal scan period is ended (just before the next rising of the horizontal synchronization signal HST). Note that the count value by the gradation counter 164 is initialized to "0", for example, when the reset signal CNT_R becomes active in accordance with the rising of the horizontal synchronization signal HST.

The comparators 163_1 to **163_*m* of m columns provided in the comparator unit 163 are operated in synchronization with a clock signal CMP CK, and make coincidence signals P1 to Pm active (e.g., the L level) at a timing when the gradation signal Cout output from the gradation counter 164 coincides with each of the video signals (line data) of m columns concurrently output from the 1-line latch unit 162**.

Other configurations and operations of the horizontal driver 16 are the same as those of the horizontal driver 56, and thus the description thereof will be omitted.

Figure 10:
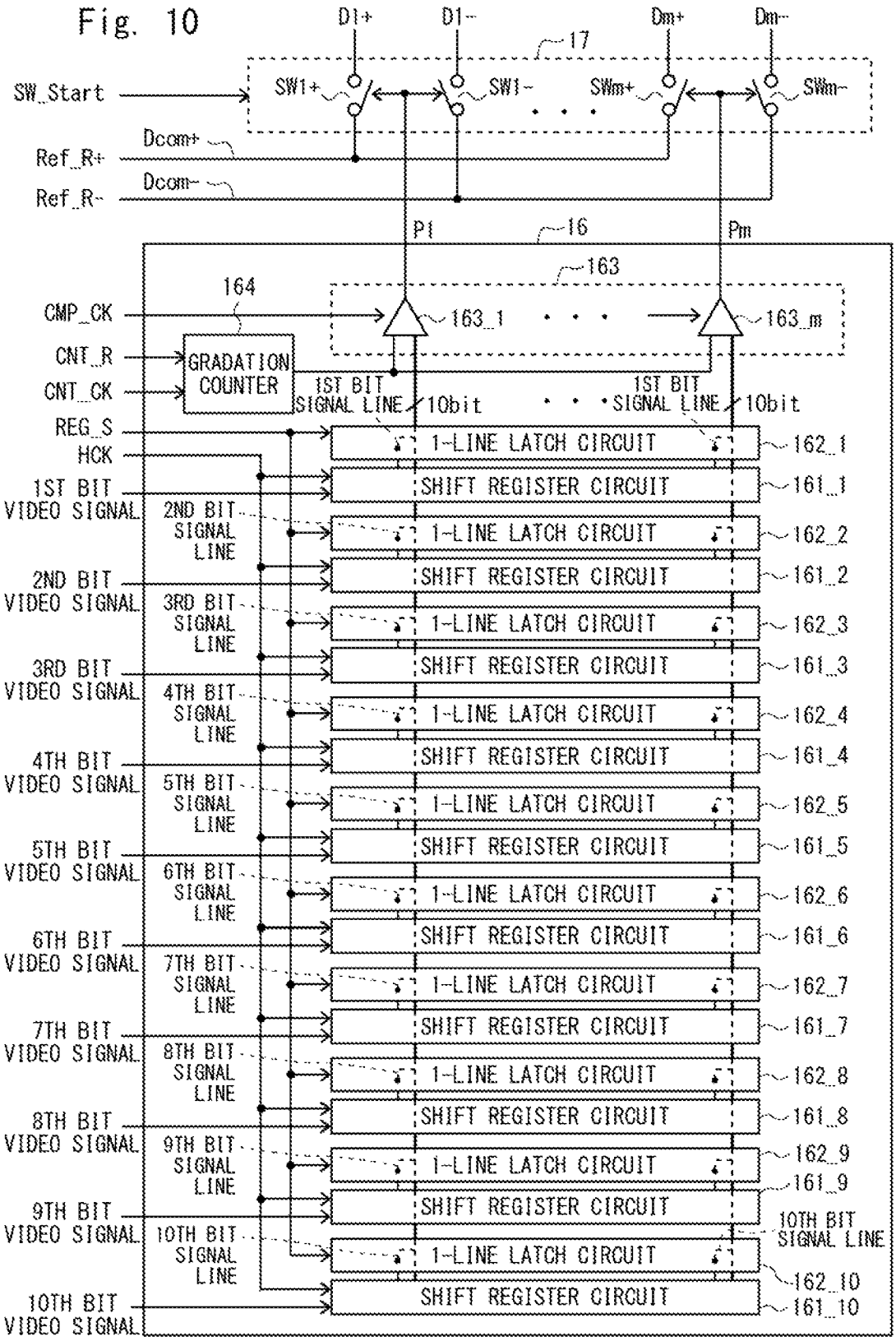
FIG. 10 is a diagram showing a horizontal driver 16 and an analog switch unit 17 provided in the liquid crystal display apparatus shown in FIG. 9 in more detail.

Specific Configuration Example of the Shift Register Unit 161 and its Peripheral Circuit FIG. 10 is a block diagram showing a specific configuration example of the shift register unit 161 and its peripheral circuits. In the example of FIG. 10, a case where the bit width of the video signal is 10 bit width (s=10) will be described. FIG. 10 also shows the 1-line latch unit 162, the comparator unit 163, the gradation counter 164, and the analog switch unit 17.

As shown in FIG. 10, the shift register unit 161 includes ten shift register circuits 161_1 to 161_10 corresponding to the bit width of the video signals. The 1-line latch unit 162 includes ten 1-line latch circuits 162_1 to 162_10 corresponding to the bit width of the video signals.

The shift register circuit 161_1 sequentially takes in, for m columns, the first bit signal which is the bit signal of the least significant bit among the first to tenth bit signals constituting the video signal having 10 bit width. Similarly, the shift register circuits 161_2 to 161_10 sequentially take in the second to tenth bit signals, respectively, for the m columns.

The 1-line latch circuit 162_1 concurrently outputs the first bit signals for the m columns taken by the shift register circuit 161_1 at the timing when the trigger signal REG_S becomes temporarily active. Similarly, the 1-line latch circuits 162_2 to 162_10 concurrently output the second to tenth bit signals for the m columns taken by the shift register circuits 161_2 to 161_10, respectively, at the timing when the trigger signal REG_S becomes temporarily active.

Here, among the first to tenth bit signals, the period of the signal change of the first bit signal, which is the bit signal of the least significant bit, is the shortest, the period of the signal change is gradually increased from the first bit signal to the tenth bit signal, and the period of the signal change of the tenth bit signal, which is the bit signal of the most significant bit, is the longest. Therefore, if the lengths of the signal lines are the same, among the first to tenth bit signal lines where the first to tenth bit signals are propagated, respectively, the progressive failure due to long-time continuous use and the failure during manufacturing processing are likely to occur in the first bit signal line where the frequently changing first bit signal is propagated.

Thus, in this embodiment, among the 1-line latch circuits 162_1 to 162_10, the 1-line latch circuit 162_1 is disposed closer to the comparator unit 163 than at least the 1-line latch circuit 162_10. More preferably, the 1-line latch circuit 162_1 is disposed closer to the comparator unit 163 than the 1-line latch circuits 162_2 to 162_10.

In this manner, the length of the first bit signal line wired from the 1-line latch circuit 162_1 to the comparator unit 163 becomes shorter than the lengths of the second to the tenth bit signal lines respectively wired from the 1-line latch circuits 162_2 to 162_10 to the comparator unit 163. Then, in the first bit signal line where the frequently changing first bit signal is propagated, even if a current leaks from the signal line to the insulating interlayer film or the wiring resistance is partially increased due to the defect during the manufacturing processing or the like, the load on the signal line is reduced because of a decrease in the time constant of RC, so that the progressive failure due to long-term continuous use is less likely to occur. As a result, the reliability of the liquid crystal display apparatus 1 is improved. The manufacturing yield is also improved.

Figure 11:
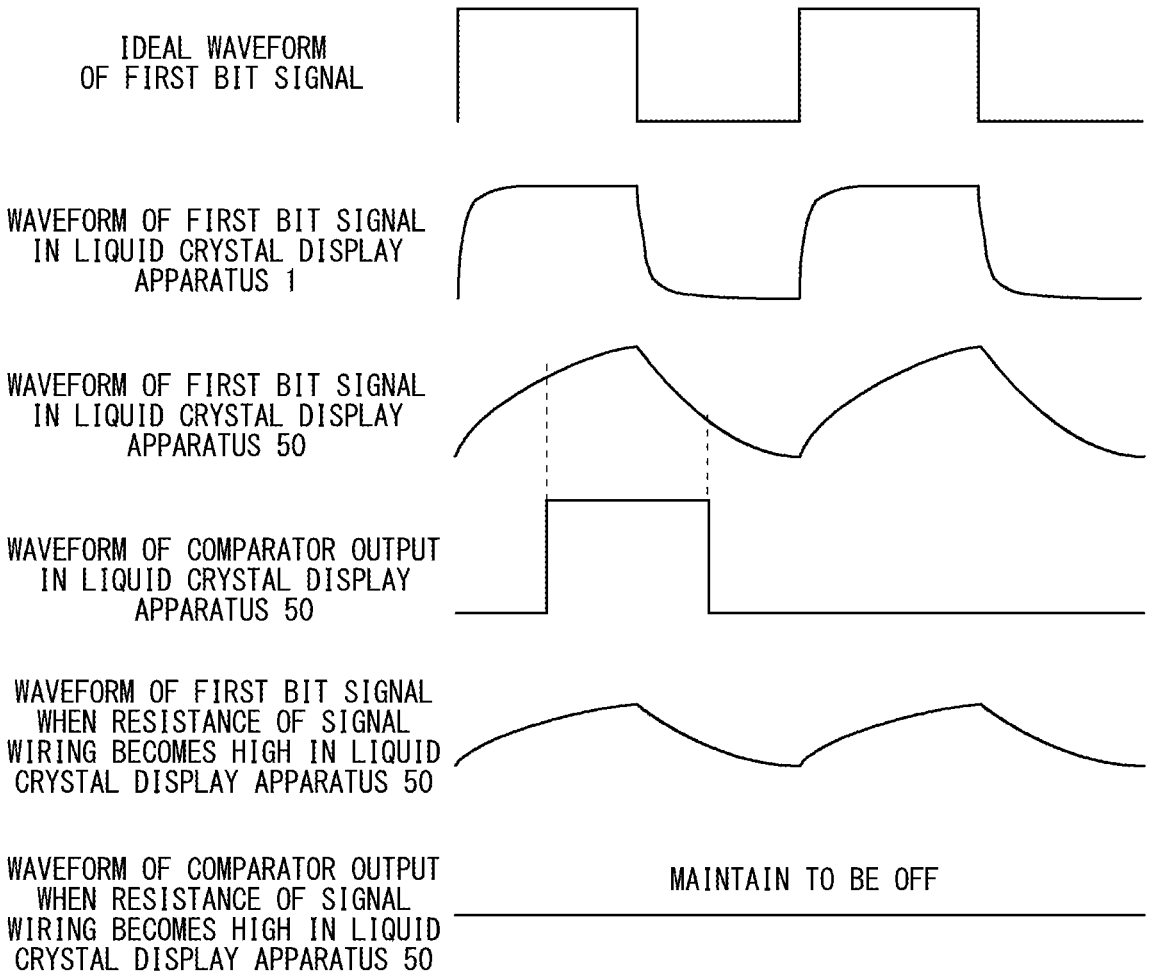
FIG. 11 shows waveforms of least significant bit signals and a comparator output waveform.

FIG. 11 shows waveforms of the video signals in the i-th column among the video signals (line data) of the least significant bits for the m columns concurrently output from the 1-line latch unit, and a waveform of a coincidence signal Pi output from the comparator unit at a timing when the video signal coincides with the gradation signal Cout.

The first row of FIG. 11 shows an ideal waveform of the first bit signal which is the least significant bit signal. As shown in FIG. 11, the ideal waveform of the first bit signal is a rectangular wave.

The second row of FIG. 11 shows a waveform of the first bit signal in the liquid crystal display apparatus 1. Specifically, the second row of FIG. 11 shows the waveform of the first bit signal when the shift register circuit 161_1 and the 1-line latch circuit 162_1 are disposed closer to the analog switch unit 17 (i.e., the comparator unit 163) than other shift register circuits and 1-line latch circuits The third row of FIG. 11 shows a waveform of the first bit signal in the liquid crystal display apparatus 50. Specifically, the third row of FIG. 11 shows the waveform of the first bit signal when circuits corresponding to the shift register circuit 161_1 and the 1-line latch circuit 162_1 are disposed farther from the analog switch unit 17 (i.e., the comparator unit 563) than other shift register circuits and 1-line latch circuits.

In the waveform of the second row of FIG. 11, compared with the waveform of the third row of FIG. 11, since the wiring length of the signal line where the first bit signal is propagated (this signal line is hereinafter referred to as a first bit signal line) is short, the RC time constant is small, and the distortion of the first bit signal is also small. On the contrary, in the waveform of the third row of FIG. 11, since the wiring length of the first bit signal line is long, the RC time constant is large, and the distortion of the first bit signal is also large.

The waveform of the fourth row of FIG. 11 shows the waveform of the coincidence signal Pi corresponding to the first bit signal shown in the third row of FIG. 11. That is, the waveform of the fourth row of FIG. 11 shows the waveform of the coincidence signal Pi when the wiring length of the first bit signal line is long. In this case, since the distortion of the first bit signal is large, the rising and falling of the comparator output are both delayed from the rising and falling of the ideal first bit signal.

The waveform of the fifth row of FIG. 11 shows the waveform of the first bit signal when circuits corresponding to the shift register circuits 161_1 and the 1-line latch circuit 162_1 are disposed farther from the analog switch unit 17 (i.e., the comparator unit 563) than other shift register circuits and 1-line latch circuits, and the first bit signal line has a high resistance due to current leakage or a manufacturing defect. In this case, since the wiring length of the first bit signal line is long, the RC time constant is large, and the distortion of the first bit signal is also large. In addition, the voltage level of the first bit signal cannot be increased so as to be more than or equal to a threshold voltage, which is determined to be an H level, due to the influence of the current leakage and the high resistance of the wiring. Therefore, as shown in the sixth row of FIG. 11, the coincidence signal Pi cannot rise to the H level and maintains itself at the L level state. That is, the liquid crystal display apparatus 50 cannot operate normally.

On the other hand, in the liquid crystal display apparatus 1 according to this embodiment, the shift register circuit 161_1 and the 1-line latch circuit 162_1 are disposed closer to the analog switch unit 17 (i.e., the comparator unit 163) than the other shift register circuits and 1-line latch circuits, and the wiring length of the first bit signal line is shorter, so that the RC time constant becomes small, and the distortion of the first bit signal becomes small. Therefore, the liquid crystal display apparatus 1 can operate normally even when slight current leakage occurs or the resistance of the wiring becomes high.

That is, the liquid crystal display apparatus 1 according to this embodiment can operate normally even when the resistance of the wiring becomes high due to the current leakage or the manufacturing defect. As a result, reliability and manufacturing yield are improved.

As described above, in the liquid crystal display apparatus 1 according to this embodiment, the bit signal lines are wired in such a way that, among the plurality of bit signals constituting the video signal, the length of the first bit signal line where the frequently changing bit signal of the least significant bit is propagated becomes shorter than the length of the second to tenth bit signal lines where the other bit signals are propagated. In this way, in the first bit signal line where the frequently changing first bit signal is propagated, even if a current leaks from the signal line to the insulating interlayer film or the wiring resistance is partially increased due to the defect during the manufacturing processing or the like, the load on the signal line is reduced due to the decrease in the time constant of RC caused by a short length of the wiring, so that the progressive failure due to long-term continuous use is less likely to occur. As a result, the reliability of the liquid crystal display apparatus 1 is improved. The manufacturing yield is also improved.

The liquid crystal display apparatus 1 according to this embodiment is used, for example, in an optical switching element of a WSS apparatus installed in an optical communication system. Here, when the liquid crystal display apparatus 1 is used for the optical switching element of the WSS apparatus, no high operating frequency is required as compared with the case where the liquid crystal display apparatus 1 is used for image display. For this reason, there is no problem even if the 1-line latch circuit 162_1 is disposed distant from the ground wiring (i.e., disposed close to the comparator unit 163) in order to shorten the first bit signal line. When the liquid crystal display apparatus 1 is used for the optical switching element of the WSS apparatus, since a slight sense of afterimage is allowed unlike the case where the liquid crystal display apparatus 1 is used for image display, there is no problem even if the 1-line latch circuit 162_1 is disposed close to the analog switch unit 17 (i.e., the comparator unit 163) in order to shorten the first bit signal line.

According to the present embodiments, there can be provided a liquid crystal display apparatus and a method of manufacturing the same which can improve reliability.

What is claimed is:

1. A liquid crystal display apparatus for an optical switching element, the liquid crystal display apparatus comprising:

a plurality of pixels;

a plurality of data lines provided so as to correspond to respective columns of the plurality of pixels;

a shift register unit configured to sequentially take in a video signal including s bit width for a number of columns of the plurality of pixels, s being an integer greater than or equal to 2;

a latch unit configured to concurrently output a plurality of the video signals taken by the shift register unit;

a plurality of comparators configured to convert the plurality of video signals output from the latch unit into a plurality of analog voltages, respectively; and an analog switch unit configured to switch whether or not the plurality of analog voltages are supplied to the plurality of data lines, respectively, wherein the shift register unit comprises first to s-th shift register circuits configured to sequentially take in first to s-th bit signals constituting the video signals including the s-bit width for the number of columns of the plurality of pixels, respectively, the latch unit comprises first to s-th latch circuits configured to concurrently output the first to s-th bit signals for the number of columns of the plurality of pixels taken by the first to s-th register circuits, respectively, and among the first to s-th latch circuits, the first latch circuit configured to concurrently output a plurality of the first bit signals, which are bit signals of a least significant bit, is disposed closer to the plurality of comparators and the analog switch unit than the s-th latch circuit configured to concurrently output the plurality of s-th bit signals, which are bit signals of a most significant bit, and operating frequencies of the first bit signals are lower than the operating frequencies when the liquid crystal display apparatus is used for image display.

2. The liquid crystal display apparatus for the optical switching element according to claim 1, wherein the first latch circuit is disposed in such a way that a plurality of signal lines wired from the first latch circuit to the respective plurality of comparators become shorter than at least a plurality of signal lines wired from the s-th latch circuit to the respective plurality of comparators.

3. The liquid crystal display apparatus for the optical switching element according to claim 1, wherein the first latch circuit is disposed closer to the plurality of comparators than a second to the s-th latch circuits are.

4. The liquid crystal display apparatus for the optical switching element according to claim 3, wherein the first latch circuit is disposed in such a way that a plurality of signal lines wired from the first latch circuit to the respective plurality of comparators become shorter than a plurality of signal lines wired from the second to s-th latch circuits to the respective plurality of comparators.

5. The liquid crystal display apparatus for the optical switching element according to claim 1, wherein the first latch circuit is disposed closer to the plurality of comparators and the analog switch unit than a distance from each of a second to the s-th latch circuits to the plurality of comparators and the analog switch unit.

6. A method of manufacturing a liquid crystal display apparatus for an optical switching element, the liquid crystal display apparatus comprising:

a plurality of pixels;

a plurality of data lines provided so as to correspond to respective columns of the plurality of pixels;

a shift register unit configured to sequentially take in a video signal including s bit width for a number of columns of the plurality of pixels, s being an integer greater than or equal to 2;

a latch unit configured to concurrently output a plurality of the video signals taken by the shift register unit;

a plurality of comparators configured to convert the plurality of video signals output from the latch unit into a plurality of analog voltages, respectively; and an analog switch unit configured to switch whether or not the plurality of analog voltages are supplied to the plurality of data lines, respectively, wherein the shift register unit comprises first to s-th shift register circuits configured to sequentially take in first to s-th bit signals constituting the video signals including the s-bit width for the number of columns of the plurality of pixels, respectively, the latch unit comprises first to s-th latch circuits configured to concurrently output the first to s-th bit signals for the number of columns of the plurality of pixels taken by the first to s-th register circuits, respectively, the method comprising disposing, among the first to s-th latch circuits, the first latch circuit configured to concurrently output a plurality of the first bit signals, which are bit signals of a least significant bit, closer to the plurality of comparators and the analog switch unit than the s-th latch circuit configured to concurrently output the plurality of s-th bit signals, which are bit signals of a most significant bit, and operating frequencies of the first bit signals are lower than the operating frequencies when the liquid crystal display apparatus is used for image display.

7. The method according to claim 6, wherein, in the disposing of the first latch circuit, the first latch circuit is disposed in such a way that a plurality of signal lines wired from the first latch circuit to the respective plurality of comparators become shorter than at least a plurality of signal lines wired from the s-th latch circuit to the respective plurality of comparators.

* * * * *